United States Patent [19]

Huang

[11] Patent Number: 5,072,341

[45] Date of Patent: Dec. 10, 1991

[54] LAMP ASSEMBLY SUSPENDED FROM A CEILING FAN

[76] Inventor: Ming-Chien Huang, No. 788, Chung-Shan Rd., Shen-Kang Hsiang, Taichung Hsien, Taiwan

[21] Appl. No.: 713,385

[22] Filed: Jun. 7, 1991

[51] Int. Cl.[5] ..... F21V 33/00

[52] U.S. Cl. ..... 362/96; 362/147; 362/253; 362/269; 362/405

[58] Field of Search ..... 362/96, 147, 148, 149, 362/218, 249, 253, 269, 285, 404, 405

[56] References Cited

U.S. PATENT DOCUMENTS

| | | | |
|---|---|---|---|
| 1,045,273 | 11/1912 | Fisher | 362/405 |
| 4,428,032 | 1/1984 | Workman | 362/96 |
| 4,796,166 | 1/1989 | Greenberg | 362/96 |
| 5,028,206 | 7/1991 | Kendregan et al. | 362/96 |

*Primary Examiner*—Ira S. Lazarus
*Assistant Examiner*—Sue Hagarman
*Attorney, Agent, or Firm*—Harness, Dickey & Pierce

[57] ABSTRACT

A lamp assembly includes a central holder attached to and disposed under the ceiling fan and having an electric wire passage, and several circumferentially equidistant illuminating units extending radially from the central holder. Each of the illuminating units includes a tubular connecting rod attached to the central holder, a rotary member connected rotatably to the connecting rod and capable of being locked on the connecting rod, a lamp equipped with an electric plug, and a reflection lamp shield connected removably to the rotary member and positioned over the lamp. The tubular connecting rod has a radial inner end fastened to and extending radially from the central holder, a central bore formed through the connecting rod in communication with the electric wire passage, and a radial outer end. The rotary member has a radial inner end connected rotatably to the radial outer end of the connecting rod, and a radial outer end equipped with an electric socket in which the electric plug is engaged. An electric wire can be passed through the electric wire passage of the central holder and through the central bore of the connecting body to couple with the rotary member.

5 Claims, 5 Drawing Sheets

LAMP ASSEMBLY SUSPENDED FROM A CEILING FAN

BACKGROUND OF THE INVENTION

1. Field of the Invention

This invention relates to a lamp assembly, more particularly to a lamp assembly suspended from a ceiling fan, which includes several detachable reflection lamp shields.

2. Description of the Related Art

The improvement of this invention is directed to a conventional lamp assembly shown in FIG. 1. As illustrated, the conventional lamp assembly is suspended from a ceiling fan 1 and includes a central holder 2 attached to the fan 1, and several circumferentially equidistant illuminating units each of which includes a tubular connecting rod 21, a lamp cover 3 connected rotatably to the corresponding connecting rod 21 and shaped in the form of a bell, and a bulb 4 disposed within the corresponding lamp cover 3. The lamp covers 3 cannot be removed from the central holder 2, resulting in difficulty in transportation. Furthermore, when the lamp covers 3 are turned upward, as shown in the dotted lines of FIG. 1, the illuminating effect of the lamp assembly is reduced.

SUMMARY OF THE INVENTION

It is therefore an object of this invention to provide a lamp assembly suspended from a ceiling fan, which can be dismounted for transportation.

Another object of this invention is to provide a lamp assembly suspended from a ceiling fan, equipped with several reflection lamp shields which do not affect the illuminating effect of the lamp assembly when they are turned upward.

According to this invention, a lamp assembly includes a central holder attached to and disposed under the ceiling fan and having an electric wire passage, and several circumferentially equidistant illuminating units extending radially from the central holder. Each of the illuminating units includes a tubular connecting rod attached to the central holder, a rotary member connected rotatably to the connecting rod, means for locking the rotary member on the connecting rod, a lamp equipped with an electric plug, and a reflection lamp shield connected removably to the rotary member and positioned over the lamp. The tubular connecting rod has a radial inner end fastened to and extending radially from the central holder, a central bore formed through the connecting rod in communication with the electric wire passage, and a radial outer end. The rotary member has a radial inner end connected rotatably to the radial outer end of the connecting rod, and a radial outer end equipped with an electric socket in which the electric plug is engaged. An electric wire can be passed through the electric wire passage of the central holder and through the central bore of the connecting rod to couple with the rotary member.

In an embodiment, the radial outer end of each of the connecting rods is U-shaped and includes two aligned clamping arms which are positioned at the same level. The clamping arms have inner surfaces defining therebetween a hole communicated with the central bore. The inner surfaces of the clamp arms have aligned circular indentions formed therein. Each of the radial inner end of each of the rotary members is round and engaged partially within the indentions of the corresponding clamping arms, so as to clamp tightly the rotary member between the clamping arms of the connecting rod. The materials of the connecting rod and the rotary member are selected so as to enable the rotary member to be forced to rotate about the connecting rod. For example, the connecting rod and the rotary member may be made of copper. In an embodiment, each of the rotary members has a dovetail groove formed in an upper surface thereof, and a threaded hole formed in a side wall of the rotary member in communication with the dovetail groove. Each of the reflection lamp shields includes a dovetail tongue engaged within the dovetail groove of the corresponding rotary member. Each of the illuminating units includes a locking bolt extending through the corresponding threaded hole to lock the reflection lamp shield on the rotary member.

BRIEF DESCRIPTION OF THE DRAWING

Other features and advantages of this invention will become apparent in the following detailed description of a preferred embodiment of this invention, with reference to the accompanying drawings, in which.

DESCRIPTION OF THE PREFERRED EMBODIMENT

Figure 1:
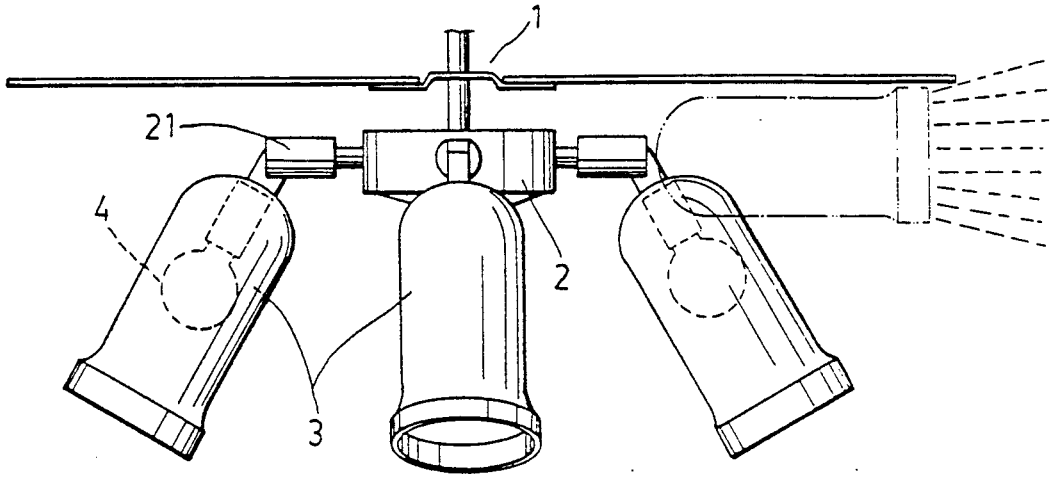
FIG. 1 PRIOR ART
FIG. 1 is a schematic view illustrating a conventional lamp assembly suspended from a ceiling fan.
Figure 2:
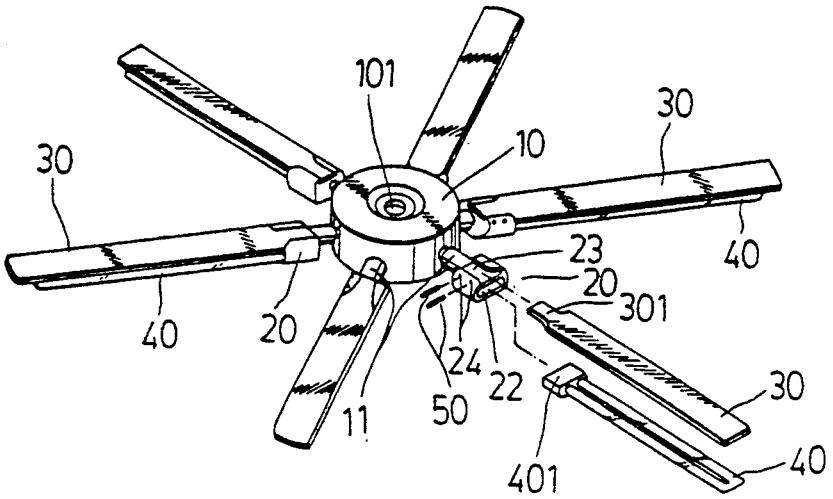
FIG. 2 is a perspective view showing a lamp assembly of this invention.

Referring to FIG. 2, a lamp assembly of this invention includes a cylindrical central holder 10 with an electric wire passage 101, and six circumferentially equidistant radially extending illuminating units. Each of the illuminating units consists of a tubular connecting rod 11, a rotary member 20, a reflection lamp shield 30 shaped in the form of a rectangular plate, and an elongated fluorescent lamp 40.

Figure 2A:
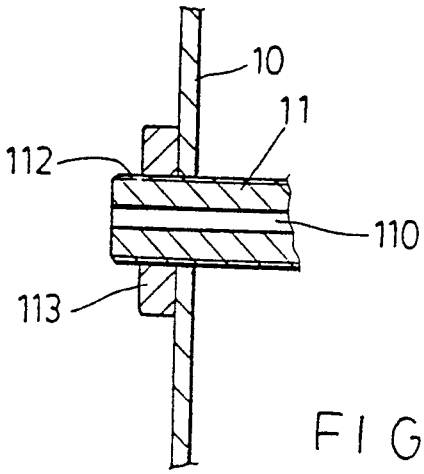
FIG. 2A is a sectional view illustrating the connection of a central holder and a connecting rod of the lamp assembly according to this invention.
Figure 3:
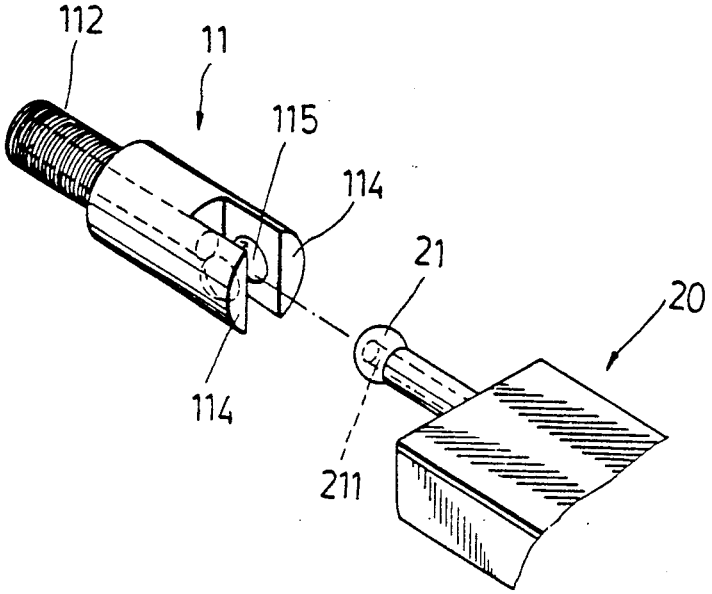
FIG. 3 is an exploded view illustrating the connection of the connecting rod and a rotary member of the lamp assembly according to this invention.
Figure 4:
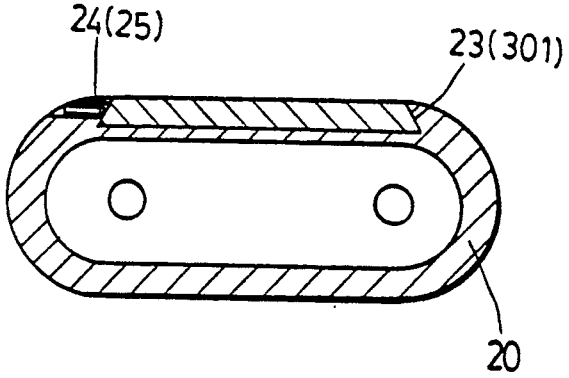
FIG. 4 is a sectional view illustrating the dovetail joint between the rotary member and a reflection lamp shield of the lamp assembly according to this invention.

The connecting rod 11 is made of copper and has a central bore 111 formed therethrough, an externally threaded radial inner end 112 (see FIG. 2A) fastened to the side wall of the central holder 10 by a nut 113, and a U-shaped radial outer end (see FIG. 3) including two clamping arms 114 defining between a hole which is communicated with the central hole 111. The inner surfaces of the clamping arms 114 have aligned circular indentions 115 which are engaged with round radial inner end 21 (see FIG. 3) of the rotary member 20, so that the clamping arms 114 can clamp tightly the round radial inner end 21 of the rotary member 20, thereby enabling the rotary member 20 to be forced to rotate about a horizontal axis, i e. the connecting line of the indentions 115. After the force of rotating manually the rotary member 20 is released, the clamping arms 114 again clamp tightly the round radial inner end 21 of the rotary member 20, so as to lock the rotary member 20 on the connecting rod 11.

The rotary member 20 is also made of copper and has a central bore 211 formed through the round radial inner end 21 thereof in communication with the central bore 111 of the connecting rod 11, an electric socket 22 installed at the radial outer end of the rotary member 20, a dovetail groove 23 formed in the upper surface of the rotary member 20 and engaged with the dovetail tongue 301 of the lamp shield 30, and two thread holes 24 formed through a side wall of the rotary member 20 in communication with the dovetail groove 23. Two locking bolts 25 are passed through the threaded holes 24, so as to lock the lamp shield 30 on the rotary member 20. The fluorescent lamp 40 is equipped with an electric plug 401 engaged within the socket 22 of the rotary member 20.

An electric wire is in turn passed through the passage 101 of the central holder 10, the central bore 111 of the connecting rod 11, and the central bore 211 of the rotary member 20 to couple with the socket 22.

It can be appreciated that the lamp shields 30 can be easily removed from the central holder 10 in order for easy transportation.

Figure 5:
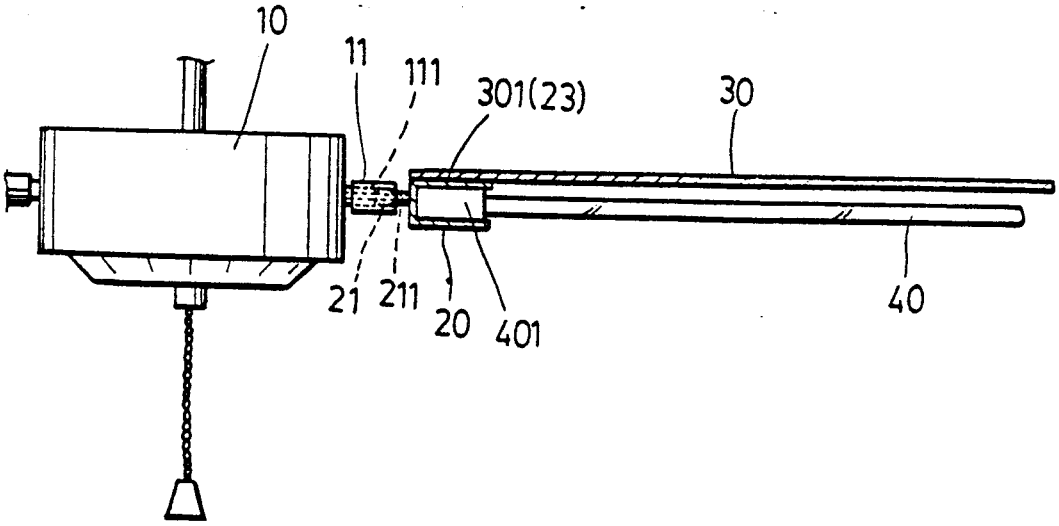
FIG. 5 is a partially sectional view illustrating the lamp assembly according to this invention.
Figure 6:
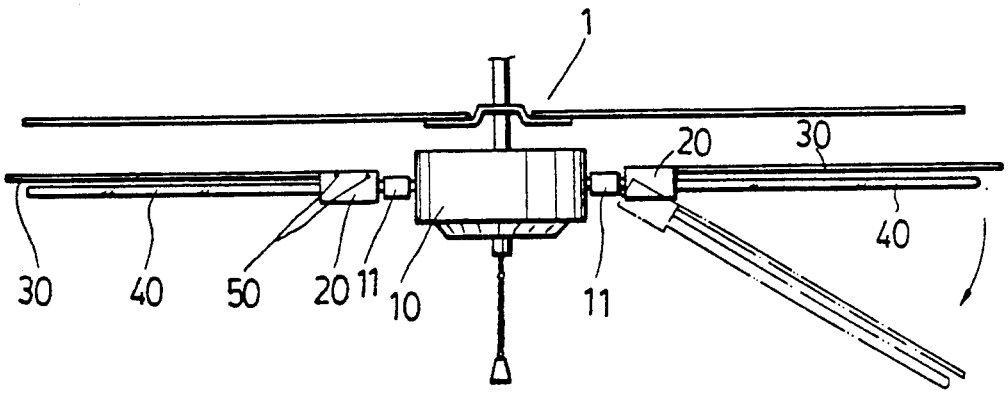
FIG. 6 is a schematic view illustrating the adjustment to one of the illuminating units of the lamp assembly according to this invention.

Referring to FIG. 5, the lamp shields 30 do not affect the illuminating effect of the lamp assembly no matter where the illuminating units are positioned. The objects of this invention is therefore achieved.

With this invention thus explained, it is apparent that numerous modifications and variations can be made without departing from the scope and spirit of this invention. It is therefore intended that this invention be limited only as indicated in the appended claims.

I claim:

1. A lamp assembly suspended from a ceiling fan, including a central holder attached to and disposed under said ceiling fan and having an electric wire passage, and several circumferentially equidistant illuminating units extending radially from said central holder, each of said illuminating units comprising:

a tubular connecting rod having a radial inner end fastened to and extending radially from said central holder, a central bore formed through said connecting rod in communication with said electric wire passage, and a radial outer end;

a rotary member having a radial inner end connected rotatably to said radial outer end of said connecting rod, and a radial outer end equipped with an electric socket;

means for locking said rotary member on said connecting rod;

a lamp equipped with an electric plug engaged within said electric socket; and a reflection lamp shield connected removably to said rotary member and positioned over said lamp;

whereby, an electric wire can be passed through said electric wire passage of said central holder and through said central bore of said connecting body to couple with said rotary member.

2. A lamp assembly as claimed in claim 1, wherein said lamp is an elongated fluorescent lamp, said reflection lamp shield being a rectangular plate.

3. A lamp assembly as claimed in claim 1, wherein said radial outer end of each of said connecting rods includes two aligned clamping arms which are positioned at the same level, said clamping arms having inner surfaces defining therebetween a hole communicated with said central bore, said inner surfaces of said clamp arms having aligned circular indentions formed therein, said radial inner end of each of said rotary members being round and engaged partially within said indentions of corresponding said clamping arms, so as to clamp tightly said rotary member between said clamping arms of said connecting rod, materials of said connecting rod and said rotary member being selected so as to enable said rotary member to be forced to rotate about said connecting rod.

4. A lamp assembly as claimed in claim 3, wherein said materials of said connecting rods and said rotary members are copper.

5. A lamp assembly as claimed in claim 1, wherein each of said rotary member has a dovetail groove formed in an upper surface thereof, and a threaded hole formed in a side wall of said rotary member in communication with said dovetail groove, each of said reflection lamp shields including a dovetail tongue engaged within said dovetail groove of corresponding said rotary member, each of said illuminating units including a locking bolt extending through said threaded hole to lock said reflection lamp shield on said rotary member.

* * * * *